US006083115A

United States Patent [19]

King

[11] Patent Number: 6,083,115

[45] Date of Patent: *Jul. 4, 2000

[54] GOLF PUTTER

[76] Inventor: Bruce King, 18383 Gallery Dr., Apt. 1104, Dallas, Tex. 75252

[ * ] Notice: Under 35 U.S.C. 154(b), the term of this patent shall be extended for 81 days.

[21] Appl. No.: 08/745,472

[22] Filed: Nov. 12, 1996

[51] Int. Cl.[7] ..... A63B 53/04

[52] U.S. Cl. ..... 473/252; 473/313; 473/314; 473/341

[58] Field of Search ..... 473/313, 314, 473/340, 341, 349, 350, 252

[56] References Cited

U.S. PATENT DOCUMENTS

| | | | |
|---|---|---|---|
| D. 246,329 | 11/1977 | Little | D21/739 |
| 3,042,405 | 7/1962 | Solheim | 473/313 |
| 3,954,265 | 5/1976 | Taylor | 473/313 |
| 4,265,451 | 5/1981 | Bernhardt | 473/313 |
| 4,655,459 | 4/1987 | Antonious | 473/338 |
| 4,999,000 | 3/1991 | Finney | 473/341 |
| 5,242,167 | 9/1993 | Antonious | 473/350 |
| 5,308,068 | 5/1994 | Strand | 473/251 |
| 5,390,919 | 2/1995 | Stubbs et al. | 473/246 |
| 5,489,097 | 2/1996 | Simmons | 473/341 |
| 5,518,235 | 5/1996 | Mendenhall | 473/314 |
| 5,544,883 | 8/1996 | Meyer | 473/341 |

OTHER PUBLICATIONS

Golf Digest p. 29, Skyway T–Line Putters, Dec. 1974.

*Primary Examiner*—Jeanette Chapman
*Assistant Examiner*—Stephen L. Blau
*Attorney, Agent, or Firm*—William D. Jackson; Locke Liddell & Sapp LLP

[57] ABSTRACT

A putter incorporating a rearwardly-facing recess having a block member to facilitate proper stroking of the ball and the follow-through of the putter head during the putting operation. The head of the golf club has a proximal heel portion, a distal toe portion, and a central portion between the two which is to be used for striking the golf ball. The golf club has a face plate which extends transversely of the club and has a front side for striking the ball and a back side. A sole plate extends rearwardly from the lower portion of the face plate and defines with the back side of the face plate a rearwardly extending recess or cavity. A block member is interposed in the rearwardly-extending recess behind the face plate and is secured to the back side of the face plate in the central portion of the club head in a configuration in which the predominant mass of the block member is at a forward location of the club head. The predominant mass of the block member occupies only a minor portion of the fore and aft cross section of the recess and is within the front triad of the recess. The shaft of the golf club is secured to the heel portion of the club head and extends upwardly to a handle portion which is displaced forwardly of the face plate. The shaft comprises a neck portion which is connected to the top of the proximal heel portion and is curved forwardly and inwardly from the proximal portion of the bulkhead and then curves back away from the club head so that the axis of the predominant shaft portion which terminates in the grip is aligned generally with the central portion of the putter head.

20 Claims, 2 Drawing Sheets

GOLF PUTTER

BACKGROUND OF THE INVENTION

Modern golf clubs, particularly those adapted for use as putters, vary widely in concept and design. A typical putter configuration is one in which the putter head has a generally vertical face (when the player addresses the ball) and a rearward portion which incorporates a cavity or recess of some sort which is located behind the face of the putter. These cavities can be configured or used in a number of ways in order to provide clubs, which are designed to accommodate various modifications or adjustments in the putter head or simply to incorporate what is considered to be an advantageous design, to aid the golfer in his making accurate putts. For example, U.S. Pat. No. 5,308,068 to Strand discloses a golf putter which has a vertically-oriented front plate which provides a ball-striking surface and a rearwardly-extending, generally horizontally-oriented, sole plate which extends backwardly from the front plate. The sole plate and the front plate form to provide a generally L-shaped head with the back of the front plate and the top of the sole plate defining a cavity or recess behind the ball striking surface. In the Strand putter, weights are provided at the toe and heel portions of the putter. The top surface of the sole plate is provided with aiming indicia at approximately the center of mass of the putter head taking into account the front plate, the sole plate, the two end weights at the heel and toe, and the hosel which provides an interconnection between the putter head and the hand shaft of the putter. The hosel is connected to the heel weight at a location to the rear of the front plate. The hosel provides a connection which is bent inwardly and then upwardly and outwardly in a goose-neck configuration to provide a shaft which ultimately terminates in a handle which is located forward of the striking face of the putter. Thus, when the golfer addresses the ball, his hands are forward of the striking surface and the golfer has a stance in which he has a clear view of the ball and the striking surface of the putter. The shaft itself is configured so that an extension of the shaft axis will fall behind the putter head at a location between the center mass of the putter face and the heel portion of the putter.

Another putter head, incorporating a rearwardly-facing cavity or recess, said to be useful in providing a number of functions, is disclosed in U.S. Pat. No. 4,655,459 to Antonious. In Antonious, the rearwardly-facing cavity is provided behind the front-striking face of the putter and extends between heel and toe portions which themselves are provided with cavities, in this case downwardly-facing cavities. This combination of a centrally-located, upwardly-facing cavity and two downwardly-facing cavities at the head and toe of the putter is described as providing a unique weight distribution system which is said to counteract the effect of torque when the ball is stroked off-center. Weights can be provided at the bottom of the upwardly-facing cavity and at the top of the downwardly-facing cavities. Alternatively, lead shot can be incorporated into the cavities and the cavities then closed by plates. Here, the club shaft is secured to the heel portion of the club head in conventional fashion.

Yet another golf club incorporating a head having a plurality of cavities, in this case two rearwardly-facing cavities opening at the top, is disclosed in U.S. Pat. No. 5,518,235 to Mendenhall. In the Mendenhall club, the putter head is provided in the back portion of the head with three struts which define two cavities. One strut is at the heel portion of the club, another at the toe portion, and the third or center strut is located about halfway between the heel and toe and has a notch in its upper surface to identify the "sweet spot" of the putter head. The proximal and distal struts at the head and toe of the putter slope downwardly and backwardly in what is described as an S-type configuration. The proximal strut at the heel of the club is provided with a rectangular aperture which extends fore and aft through the club from the front face of the club head to the rear surface of the strut. This aperture receives an arm of a corresponding rectangular configuration which serves to connect the hosel of the club shaft to the front face of the putter. The hosel terminates in a socket which receives the club shaft in a manner so that it is generally aligned in a plane which is parallel to the striking pad and extends through the center line of the ball being addressed by the club head. While the proximal and distal struts slope downwardly in the S-shaped surface described previously, the center strut extends throughout its full height for most of its rearward extension so that it provides a substantially greater mass than the proximal and distal struts.

Yet another putter configuration in which a rearwardly-facing cavity is provided to accommodate an adjustable weight at various locations along the club head is disclosed in U.S. Pat. No. 5,390,939 to Stubbs. This patent discloses a putter head which is characterized as symmetrical (for use as a right- or left-handed putter) in that the toe and head portions are the same and may be provided with press-fitted brass weights. The front face of the club is provided with a number of transversely-located bores which can be used with pins to locate a block member at any one of several transverse locations along the club head. A hosel member in turn can be secured to the back of the block member in an orientation in which the hosel and, therefore, the club shaft can be adjusted to provide for use by a right- or left-handed golfer.

Finally, U.S. Pat. No. 4,265,451 to Bernhardt discloses a putter in which the club head is configured to provide recesses which are located on either side, one near the heel and the other near the toe of the interconnection between the club face and the neck member used to secure the shaft to the club head. This design is said to produce a distribution or weight which produces an acceptable stroke at any point of impact across the entire area of the ball-striking surface.

SUMMARY OF THE INVENTION

In accordance with the present invention, there is provided a golf club, especially adapted for use as a putter, which incorporates a rearwardly-facing recess having a block member to facilitate proper stroking of the ball and the follow-through of the putter head during the putting operation. The golf club can be characterized as having a proximal heel portion, a distal toe portion, and a central portion between the two which is to be used for striking the golf ball. The golf club has a face plate which extends transversely of the club and has a front side and a back side. A sole plate extends rearwardly from the lower portion of the face plate. The upper side of the sole plate defines with the back side of the face plate a rearwardly extending recess or cavity. A block member is interposed in the rearwardly-extending recess behind the face plate. The block member is secured to the back side of the face plate in the central portion of the club head and is configured so that the predominant mass of the block member is at a forward location of the club head. Preferably, the predominant mass of the block member occupies only a minor portion of the fore and aft cross section of the recess and is within the front triad of the recess. More preferably the predominant mass of the block member is in the front quadrant of the recess. The shaft of the golf club is secured to the heel portion of the club head and extends upwardly to a handle portion which is displaced forwardly of the face plate.

In a preferred embodiment of the invention, the club head comprises a proximal bulkhead member at the heel portion of the golf club and a distal bulkhead member at the toe portion of the club head, both extending rearwardly from the face plate and upwardly from the sole plate. Thus, the face plate in combination with the bulkhead members closes the recess at its ends to define a cavity which is closed at its ends by the bulkhead members and is open rearward and upward of the club head. Preferably, the mass of the proximal bulkhead is greater than the mass of the distal bulkhead. The mass of the central block member is less than the mass of the proximal bulkhead. The shaft comprises a neck or hosel portion which is connected to the top of the proximal bulkhead. The neck portion of the shaft is curved forwardly and inwardly from the proximal portion of the bulkhead and then curves back away from the club head so that the axis of the predominant shaft portion which terminates in the grip is aligned generally with the central portion of the putter head. Preferably, the line of sight down the shaft extends along an axis which, at the level of the club head, will intersect a vertical plane extending longitudinally through the block member of the club head.

DETAILED DESCRIPTION OF THE INVENTION

The present invention provides a novel putter of the type having a rearwardly and upwardly opening recess or cavity that provides for unique weight distribution for the putter head to promote follow-through of the putter when the ball is being stroked while at the same time compensates in a manner to accommodate the ball being mishit. The putter of the present invention incorporates several unique features involving the orientation of the club shaft with the club head and the orientation and distribution of weight in the putter head which avoids large torque moments should the ball be mishit which would tend to open the face of the putter during the putting operation.

Figure 1:
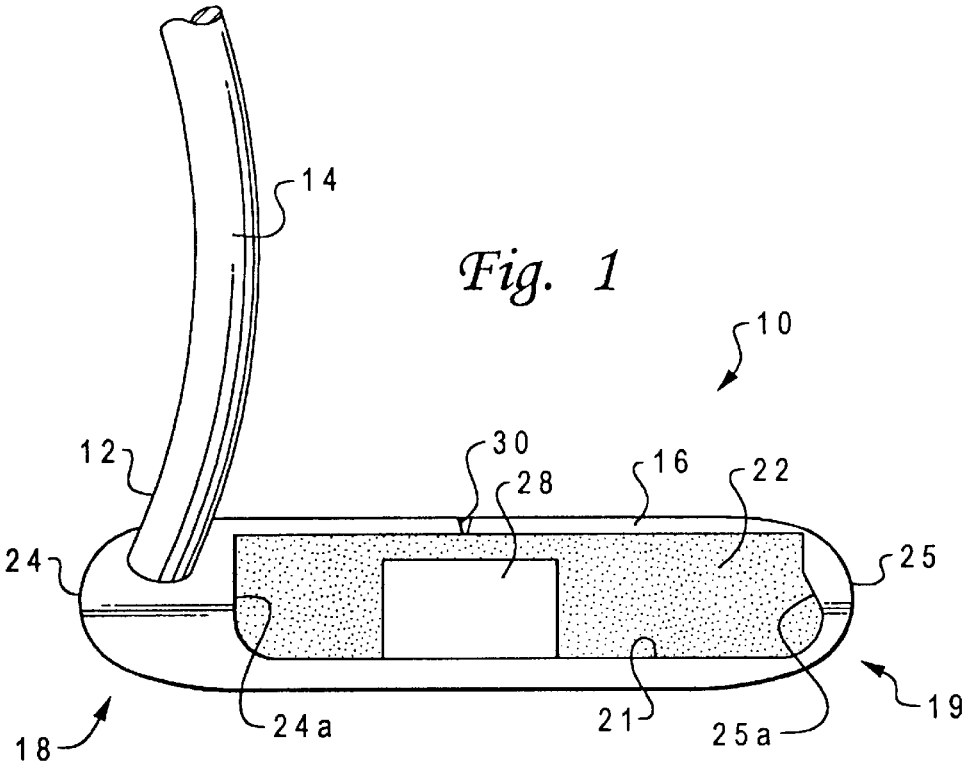
FIG. 1 is a perspective view of a putter incorporating the present invention as viewed from above and behind the putter head.

Referring now to the drawings, and more particularly to FIG. 1, there is shown a perspective view of a putter head incorporating the present invention as viewed from behind and above the putter head. As shown in FIG. 1, a putter head 10 is connected through the curving, gooseneck section 12 to a longitudinally extending putter shaft 14 which terminates at its upper end in a grip section 15 (not shown in FIG. 1). The putter head is characterized by a face plate 16 extending transversely along the club head from the proximal heel portion 18 to the distal toe portion 19. The face plate is joined to a sole plate 21 which defines a rearwardly and upwardly-facing cavity 22. In the preferred embodiment of the invention illustrated, the club head is provided with a relatively massive proximal bulkhead member 24 which extends backwardly from the face plate and upwardly from the sole plate and a substantially less massive distal bulkhead 25 likewise extending rearwardly from the face plate and upwardly from the sole plate. As shown, the bulkhead member at the distal end of the club is relatively thin in order to incorporate an insubstantial amount of weight at the outer or toe end of the club in order to compensate for mishit balls in a manner described later.

A block member 28 is interposed in the rearwardly-facing cavity behind the back surface of the face plate and extends upwardly from the upper surface of the sole plate. The block member, providing a mass which is disposed well forward in the club configuration which provides for good follow-through during the putting stroke, is described below. The block member is disposed centrally in the putter head as considered transversely along the face of the putter head and preferably is centered generally about the mid-point of the striking face as indicated by aiming notch 30. Hence, the rearwardly-facing cavity 22 is somewhat eccentrically displaced in the direction of the toe portion of the club. The weight 28 is necessarily offset somewhat in the cavity, being spaced somewhat closer to the heel terminus of the cavity as defined by the inner surface 24*a* of the bulkhead 24*a* than to the outer terminus of the cavity defined by the inner surface 25*a* of the distal bulkhead 25.

Figure 2:
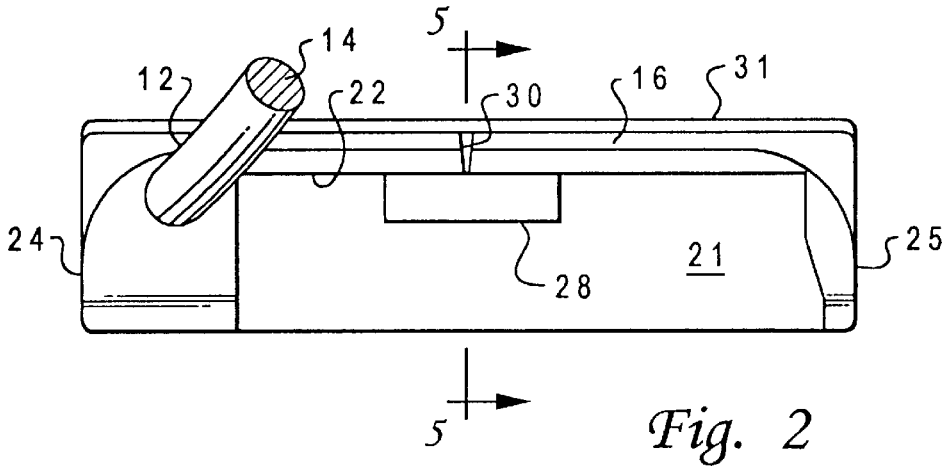
FIG. 2 is a top view of the putter of FIG. 1.
Figure 3:
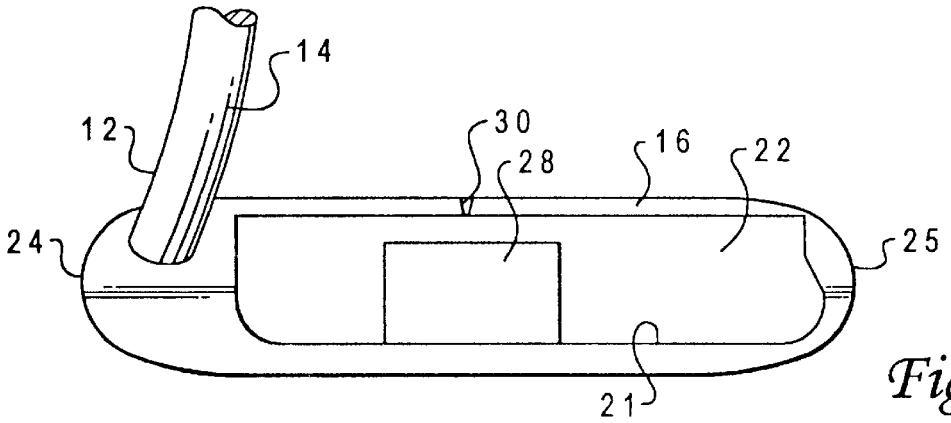
FIG. 3 is a side elevation as viewed from the rear of the putter of FIG. 1.

FIGS. 2 and 3 are top and rear elevations, respectively, of the putter head of the present invention showing the significant relationship of the mass distribution within the putter head and the orientation of the putter shaft relationship to the face of the putter. As shown in FIG. 2, the front stricking face 31 extends substantially the entire transverse dimension of the putter head. The weight distribution along the stroking face of the face plate is defined by the face plate 16 and the sole plate 21, which provide for relatively uniform weight distribution transversely of the putter head, and the bulkheads 24 and 25 and central block 28, which provide concentrated weight distributions in the putter head. The putter head may be formed of separate components or carved from a block of brass or steel ingot, or it may be cast together to provide the various components as part of a single unitary casting. The various members, particularly the block component, may be made of materials of different densities, but for purposes of the present discussion, it will be assumed that the cavity-defining components of the putter head are cast together in a single, unitary casting and the central block component 28 machined and added later and formed of the same material. Preferably, the putter head will be formed of a corrosion-resistant metal alloy having a density of about 8 or 9. Brass or stainless steel normally will be used. Since, as described below, the block member may take the form of various configurations to impart desired weight and functional characteristics to the putter head, it may be cast separately and secured in place by welding, brazing, or the like. Alternatively, where it is desired to provide a putter head with having several different block members to enable the individual golfer to tailor the putter to his needs, the central block member 28 can be held in place by a plurality of machine screws (not shown).

As shown in FIGS. 2 and 3, the proximal bulkhead 24 is relatively massive in the relationship to both the distal bulkhead 25 and the central weighting block 28. As shown in FIGS. 2 and 3, and assuming the bulkheads 24 and 25 are formed of the same material, i.e. have the same density, the transverse width of the bulkhead 24 is at least twice, and preferably at least three times, that of the distal bulkhead 25. The relatively-substantial transverse dimension of the proximal bulkhead provides a substantial anchoring system for connection of the shaft 14 to the putter head, but more significantly, it also functions to bias the mass of the putter head inwardly in close proximity to the golfer. At the same time, the central block member 28 provides a localized concentration of mass which is one located centrally of the striking face 31 in a relatively forward portion of the putter head in terms of the fore and aft dimensions of the putter head. This combination of weight distributions offers several important advantages. In the ideal situation, where the ball during the putting stroke is contacted so that the ball is generally centered by the aiming notch 30, the club face can be expected to remain "square" to the desired line of travel resulting in an accurate putt. By locating the central block member 12 well forward, the weight distribution of the putter actively promotes a good follow-through during the course of the putting stroke. The block member should be configured so that its center of gravity is within the forward half of the putter head as measured longitudially along the fore and aft axis and preferably within the first one-third or front triad of the recess, more desirably within the front quadrant of the recess 21.

Since the shaft is connected through the gooseneck 12 to the putter at the proximal end, although as discussed below the shaft orientation is such to promote a putting stroke along the center of the putter head, a torque moment is produced around the connection of the gooseneck portion 12 to the putter head. The torque moment is, of course, a function of distance from the shaft head connection and the force. By placing the overall mass of the putter head close to the proximal end of the putter head, generally in the area from the center of the putter head to the proximal end of the putter, a large torque moment is avoided at the stroking face near the distal end of the putter head. Thus, if the ball is slightly mishit so that the striking point is outside of the aiming notch 30, a large torque moment is avoided which would result in opening the face of the putter head and misdirecting the ball along a line outside of the cup as viewed from the golfer's stance.

Figures 4, 5, 6, 7:
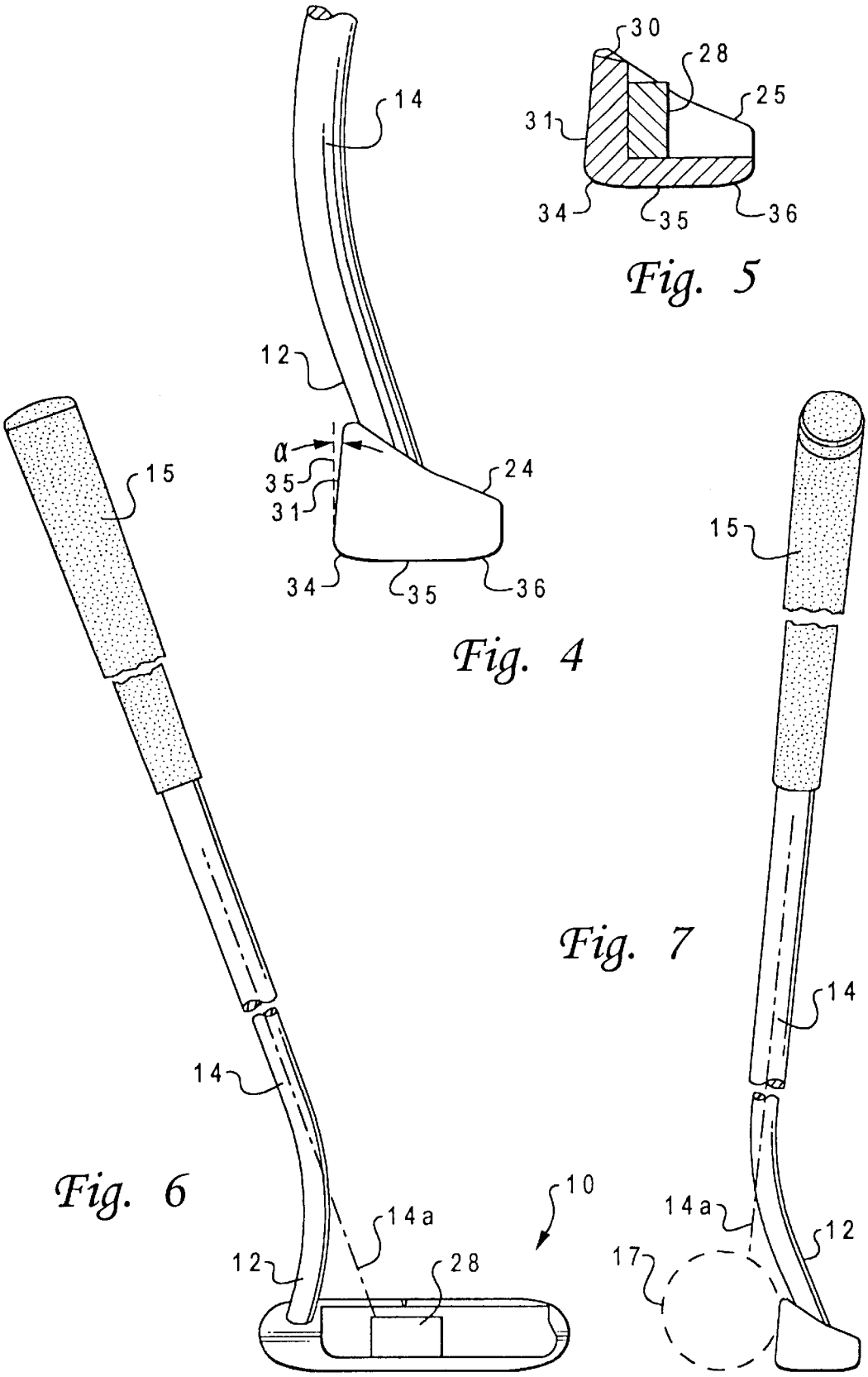
FIG. 4 is a end view of the putter in FIG. 1 as viewed from the proximal end of the putter head.
FIG. 5 is a sectional view taken along line 5—5 of FIG. 2.
FIG. 6 is a rear elevational view of a putter incorporating a preferred embodiment of the invention.
FIG. 7 is a side elevational view of the putter of FIG. 6 in proximity to a golf ball.

FIG. 4 is an end elevational view of the putter head as viewed from the proximal side of the club, and FIG. 5 is a sectional view taken along line 5—5 of FIG. 2. As shown in both FIGS. 4 and 5, the lower forward edge of the putter head as formed by the junction of the face plate 16 and sole plate 21 is rounded or beveled as indicated by reference numeral 34. As noted previously, the forward weight distribution of the putter head promotes a good follow-through during the course of the putting stroke. The beveled front edge portion 34 prevents, or at least lessens, the tendency of the putter head to dig into the green during the course of the intermediate portion of the cutting stroke just before the putter face contacts the ball. Although less significant, the back portion of the sole plate is rounded or beveled as indicated at reference numeral 36 in order to similarly retard the tendency of the putter from digging into the green at the start of the backstroke.

Generally, the intermediate portion of the bottom of the putter head, as indicated by reference numeral 35, is relatively flat. It can be somewhat convex as viewed in FIGS. 4 and 5, but if so, the radius of curvature of the intermediate portion 35 is substantially greater than curved sections 34 and 36 so that the putter will rest comfortably on the ground in a stable configuration. As also shown in FIG. 4, the striking face 31 slopes upwardly and backwardly somewhat so that it is inclined at a slight angle from the vertical when the putter head is resting on a horizontal surface. This is indicated by the angle $\alpha$ between the vertical as indicated by broken line 35a and the face 31. Angle $\alpha$ need only be a slight angle, usually no more than 6° and preferably about 3–5°.

FIGS. 6 and 7 are rear and side elevations, respectively, showing the orientation of the putter shaft relative to the putter head 10. As shown in FIG. 6 (and also in FIGS. 2 and 3), the gooseneck portion 12 of the putter shaft, as it moves away from the top of the putter, moves initially outwardly toward the distal end and then turns back at an obtuse angle so that it slopes away from the central portion of the putter head where the gooseneck portion joins the main portion of the shaft 14. The grip 15 of the shaft 14 will normally be displaced horizontally away from the proximal end of the putter head by about 6–10 inches. As viewed fore and aft, as shown in FIG. 7 and also in FIGS. 2 and 4, the shaft initially curves forward and then in a generally vertical direction along the straight portion of the shaft 14 so that the putter's hands during the putting stroke will be slightly forward of the putting face 31. Thus, as viewed from the end of the putter as shown in FIG. 7, the vertical shaft 14 extends generally vertically from the putter head in a relationship so that the shaft portion 14 and grip 15 is slightly ahead of the face of the putter. The relationship of the shaft portion 14 and the putter head can be viewed in FIG. 7 and also in FIG. 6 by reference to broken line 14 a which shows an extension of the shaft 14 to the elevation of the putter head. As shown in FIG. 6, the line of sight down the shaft length 14 as indicated by broken line 14*a* will, at the level of the putter head, intersect a forward projection of the central portion of the putter head and preferably a forward projection of the block 28. As best shown in FIG. 7, the line of sight down the shaft 14 as indicated by broken line 14*a* falls slightly in front of the putting face 31 so that it intersects a standard golf ball 17 (shown in phantom), having a diameter of about 1.7 inches, as the striking face of the putter head contacts the ball. This configuration permits the shaft to be connected to the proximal end of the putter with the advantages noted above, while at the same time presenting a configuration as viewed by the golfer so that the major portion of the shaft terminating in the handle is generally aligned with the central portion of the club head as viewed along the transverse dimension of the club head and with the ball itself as viewed fore and aft. The golfer is, thus, provided with a clear view of the face of the putter and the ball during the putting stroke and provides a configuration in which the golfer's eye is naturally directed to stroke the ball so that it is contacted generally along the "sweet spot" of the putting face in front of the block member 28.

The putter may be formed of any suitable material. The head itself will normally be metallic, made of a non-corrosive material such as stainless steel or brass. Preferably, the face of the putter and the upper surfaces are polished while the upwardly-facing cavity surfaces are not polished. Preferably, the upper surface of the block member, as well as the back of the block member, is also polished. This provides a contrast with the somewhat-subdued or darkened portions of the cavity. Thus, returning to a consideration of FIG. 1, the backside of the face plate 16, the top of the sole plate 21, and the inside surfaces of bulkheads 24 and 25 preferably are relatively dark, e.g. brown or black, whereas the remaining surfaces, including the block member, are polished. Again, the golfer's eye is directed primarily to the central portion or "sweet spot" of the putting face.

The distal and proximal bulkheads preferably slope downwardly and rearwardly as best shown in FIGS. 4 and 5. This tends to promote the forward distribution of weight in the putter head, although not as dramatically as the L-shaped cross-section defining the cavity 22, and the forward placement of the center weight member, and, in addition, facilitates use of the putter head to pick the ball up out of the hole or, in the case of a "gimme" off the green. In this respect a portion of the recess between the distal bulkhead 25 and the center block member 28 forms a pocket which can be used to scoop the ball up while the golfer remains erect.

Having described specific embodiments of the present invention, it will be understood that modifications thereof may be suggested to those skilled in the art, and it is intended to cover all such modifications as fall within the scope of the appended claims.

What is claimed:

1. In a golf club adapted for use as a putter, the combination comprising:

a) a club head having a proximal heel portion, a distal toe portion having a mass which is less than the mass of the proximal heel portion, and a central portion adapted to be used in striking a golf ball, said club head having a face plate extending transversely of said club head and having a front surface defining a striking face and a back side;

b) a sole plate extending rearwardly from the lower portion of said face plate and defining with the back side of said face plate a rearwardly-extending recess behind said face plate and above said sole plate;

c) a block member interposed in said rearwardly-extending recess behind said face plate and secured to the back side of said face plate in the central portion of said club head to provide a mass of said block member which is less than the mass of the proximal heel portion of said club head and the predominant mass of said block member being at a forward location of said club head; and d) a shaft extending upwardly from the heel portion of said club head and terminating in a handle portion displaced forwardly of the face plate and aligned with a location in front of the face plate of said club head.

2. The combination of claim 1 wherein the predominant mass of said block member is within the front triad of said recess.

3. The combination of claim 1 wherein the predominant mass of said block member is in the front quadrant of said recess.

4. The combination of claim 1 wherein said club head further comprises a proximal bulkhead member extending rearwardly from said face plate and upwardly from said sole plate at the heel portion of said club head and a distal bulkhead extending rearwardly from said face plate and upwardly from said sole plate at the toe portion of said club plate to enclose the rearwardly-facing cavity of said club head at the proximal and distal portions of said club head.

5. The combination of claim 4 wherein the mass of said central block member is less than the mass of said proximal bulkhead.

6. The combination of claim 5 wherein the mass of said proximal bulkhead is greater than the mass of said distal bulkhead.

7. The combination of claim 6 wherein said distal and proximal bulkheads slope downwardly and rearwardly from said face plate.

8. The combination of claim 4 wherein said shaft comprises a neck portion connected to the top of said proximal bulkhead.

9. The combination of claim 8 wherein said neck portion of said shaft is curved forwardly and inwardly from said proximal bulkhead and terminates in a longitudinal shaft portion with the axis of said shaft portion being aligned generally with the central portion of said putter head between said distal and proximal bulkheads.

10. The combination of claim 1 wherein said block member is adjacent to the back side of said face plate throughout a major portion of the vertical dimension of said back side and throughout a minor horizontal dimension of the back side of said face plate.

11. The combination of claim 1 wherein the exposed surfaces of said recess as defined by the backside of said face plate and the upper surface of said sole plate are dark in relation to an exposed surface of said block member whereby said block member is emphasized as viewed from the top of said club head.

12. The combination of claim 1 wherein the lower forward portion of said club head as defined by the intersection of said face plate, and said sole plate has a beveled configuration.

13. The combination of claim 1 wherein the front surface of said face plate slopes upwardly and backwardly to define an angle from the vertical when said club head is resting on a horizontal surface.

14. In a golf club adapted for use as a putter, the combination comprising:

a) a club head having a proximal heel portion, a distal toe portion, and a central portion adapted to be used in striking a golf ball, said club head having a face plate extending transversely of said club head and having a front surface defining a striking face and a back side;

b) a sole plate extending rearwardly from the lower portion of said face plate and defining with the back side of said face plate a rearwardly-extending recess behind said face plate and above said sole plate;

c) a proximal bulkhead member extending rearwardly from said face plate and upwardly from said sole plate at the heel portion of said club head and a distal bulkhead extending rearwardly from said face plate and upwardly from said sole plate at the toe portion of said club plate to enclose the rearwardly-facing cavity of said club head at the proximal and distal portions of said club head, said proximal bulkhead having a mass which is greater than the mass of said distal bulkhead;

d) a block member interposed in said rearwardly-extending cavity behind said face plate between said proximal and distal bulkheads and secured to the back side of said face plate in the central portion of said club head to provide the predominant mass of said block member at a forward location of said club head; and e) a shaft extending upwardly from the heel portion of said club head and comprising a neck portion secured to the upper surface of said proximal bulkhead and which is curved forwardly and inwardly from said proximal portion of said bulkhead to a longitudinal portion of said shaft provided with a grip section.

15. The combination of claim 14 wherein the longitudinal portion of said shaft is configured so that a line of sight down said shaft is aligned with the vicinity of the central portion of said club head at the level of said club head.

16. The combination of claim 15 wherein said line of sight falls in front of said striking face by a distance less than the diameter of a standard golf ball.

17. The combination of claim 16 wherein said distal and proximal bulkheads slope downwardly and rearwardly from said face plate and wherein the mass of said proximal bulkhead is greater than the mass of said distal bulkhead.

18. The combination of claim 17 wherein the exposed surfaces of said recess as defined by the backside of said face plate and the upper surface of said sole plate are dark in relation to an exposed surface of said block member whereby said block member is emphasized as viewed from the top of said club head.

19. The combination of claim 18 wherein the front surface of said face plate slopes upwardly and backwardly to define an angle from the vertical when said club head is resting on a horizontal surface.

20. In a golf club adapted for use as a putter, the combination comprising:

a) a club head having a proximal heel portion, a distal toe portion which has a mass which is less than the mass of said proximal heel portion, and a central portion adapted to be used in striking a golf ball, said club head having a face plate extending transversely of said club head and having a front surface defining a striking face and a back side;

b) a sole plate extending rearwardly from the lower portion of said face plate and defining with the back side of said face plate a rearwardly-extending recess behind said face plate and above said sole plate;

c) a proximal bulkhead member extending rearwardly from said face plate and upwardly from said sole plate at the heel portion of said club head to enclose the rearwardly-facing cavity of said club head at the heel portion of said club head;

d) a block member having a mass which is less than the mass of said proximal bulkhead interposed in said rearwardly-extending cavity behind said face plate between and spaced from said proximal and distal portion and secured to the back side of said face plate in the central portion of said club head to provide the predominant mass of said block member at a forward location of said club head; and e) a shaft extending upwardly from the heel portion of said club head and comprising a neck portion secured to said proximal bulkhead which is curved forwardly and inwardly from said proximal portion of said bulkhead to a longitudinal portion of said shaft provided with a grip section and configured so that a line of sight down said shaft is aligned with the vicinity of the central portion of said club head at the level of said club head.

* * * * *